US006053491A

United States Patent [19]

Cheong

[11] Patent Number: 6,053,491

[45] Date of Patent: Apr. 25, 2000

[54] SHEET FEEDER

[75] Inventor: Sang-Won Cheong, Seoul, Rep. of Korea

[73] Assignee: SamSung Electronics Co., Ltd., Kyungki-do, Rep. of Korea

[21] Appl. No.: 08/959,068

[22] Filed: Oct. 28, 1997

[30] Foreign Application Priority Data

Oct. 28, 1996 [KR] Rep. of Korea ..... 96-49294

[51] Int. Cl.[7] ..... B65H 3/44

[52] U.S. Cl. ..... 271/9.09; 271/171

[58] Field of Search ..... 271/9.09, 117, 271/127, 157, 160, 170, 171

[56] References Cited

U.S. PATENT DOCUMENTS 4,212,456 7/1980 Ruenzi .
4,585,218 4/1986 Williams et al. .
4,884,796 12/1989 Daboub .
4,925,062 5/1990 Tsukamoto et al. .
5,058,874 10/1991 Miyoshi et al. .
5,240,239 8/1993 Kim .
5,348,283 9/1994 Yanagi et al. ..... 271/127
5,419,543 5/1995 Nakamura et al. .
5,501,444 3/1996 Yukimachi et al. .
5,890,707 4/1999 Allibert et al. ..... 271/9.09
5,913,510 6/1999 Kiyohara et al. ..... 271/9.09

*Primary Examiner*—David H. Bollinger
*Attorney, Agent, or Firm*—Robert E. Bushnell, Esq.

[57] ABSTRACT

A sheet feeder that has a first paper guide for automatic paper feeding built into a second paper guide used for manual paper feeding. Both of the guides recess into the tray of the sheet feeder and can be rotated simultaneously into a position perpendicular to the tray. When using non standard sized printable medium the dual guides make it easy to select between automatic and manual sheet loading mode. This increases the reliability of the sheet feeder and, thus, improves the functioning of the image forming apparatus.

20 Claims, 8 Drawing Sheets

SHEET FEEDER

CLAIM OF PRIORITY

This application makes reference to, incorporates the same herein, and claims all rights accruing thereto under 35 U.S.C. §119 through my patent application entitled Paper Feeder earlier filed in the Korean Industrial Property Office on the Oct. 28, 1996 and there duly assigned Ser. No. 1996/49294.

BACKGROUND OF THE INVENTION

1. Field of the Invention

The present invention relates to a sheet feeder for an image formation apparatus and, more specifically, to a sheet feeder that has rotatable guides for selecting an automatic or a manual sheet feeding mode.

2. Background Art

An image formation apparatus (e.g., a printer, scanner, facsimile or copier) must often accommodate printable mediums having a thickness or dimensions different from that of standard paper. Envelopes, postcards, transparencies, labels and resume paper are just a few examples of the different printable mediums that a sheet feeder must accommodate. A sheet feeder may be constructed to use a tray that supplies paper to a printer. The tray often has an adjustment lever allowing the paper to be moved away from a pickup roller in order to load additional sheets of paper into the tray. After loading additional paper, the adjustment lever is moved in a direction opposite that used for preparing the tray to receive additional paper causing the pickup roller to press against the paper on the tray and then transfer the paper to a transfer roller. Then, the transfer roller transports the sheet of paper to the printer cartridge.

Other sheet feeding devices have also been developed, such as, U.S. Pat. No. 5,419,543 to Nakamura entitled Paper Feeding Apparatus for Printer, that shows a paper tray pushed by a bell crank towards a pickup roller at regular intervals to load paper. U.S. Pat. No. 4,585,218 to Williams entitled Mechanism for Feeding Similar Flat Items in Succession From a Stack Thereof, U. S. Pat. No. 5,501,444 to Yukimachi entitled Sheet Supply Apparatus, and U.S. Pat. No. 5,058,874 to Miyoshi entitled Automatic Document Conveying Device, each mention an automatic sheet feeder that has the pickup roller lifted away from the paper stack at regular intervals by a bell crank device. U.S. Pat. No. 4,212,456 to Ruenzi entitled Apparatus for Automatically Feeding Individual Sheets From a Stack Through an Office Machine, mentions an automatic sheet feeder used in conjunction with a page separator, U.S. Pat. No. 5,240,239 to Kim entitled Paper Sheet Feeding Apparatus, shows an automatic sheet feeder that sequentially loads sheets into a printer. Both U.S. Pat. No. 4,925,062 to Tsukamoto entitled Sheetfeeder and U.S. Pat. No. 4,884,796 to Daboub entitled Singulator for Document Feeder, use solenoids in their gearing mechanisms in conjunction with their automatic sheet feeders.

I have observed that when a printable medium is used in a sheet feeding device that has a greater thickness or different dimensions than that of standard paper, the sheet separator is not usable. This causes difficulty with the printing process and makes it necessary to manually feed the printable medium through the sheet feeder.

SUMMARY OF THE INVENTION

Accordingly, it is an object of the present invention to provide an improved sheet feeding device.

It is another object to provide a sheet feeder that allows a user to choose between an automatic or a manual sheet feeding mode when using a printable medium having non standard thickness or dimensions.

It is still another object to provide a sheet feeder that enhances the performance of an image forming apparatus performance.

To achieve these and other objects, a sheet feeding device may be constructed with a frame containing a spring biased tray that supports any stacked printable medium so that the top sheet is in the same plane as the sheet separator and the feed roller. A portion of the tray has a frictional surface on one end and the tray is hingedly attached to the frame on another end. Paper is stacked on the tray and fed into the image forming apparatus by feed rollers. A first and second guide are used to allow the feed rollers to be separated from the tray by a greater distance than that used when operating in automatic sheet loading mode. Either guide can be rotated through an angle of 90° into a position perpendicular to the tray to serve as a guide for paper stacked on the tray. The second guide is designed to automatically rotate the first guide while the second guide is being rotated. If the first guide is rotated then there is no change in the relative position between the tray and the feed roller. When the second guide is rotated, the tray is pushed down and the relative distance between the feed rollers and the tray is increased. The first and second guides are contactable using a projection attached to the first guide that is matable with a groove positioned on the second guide.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
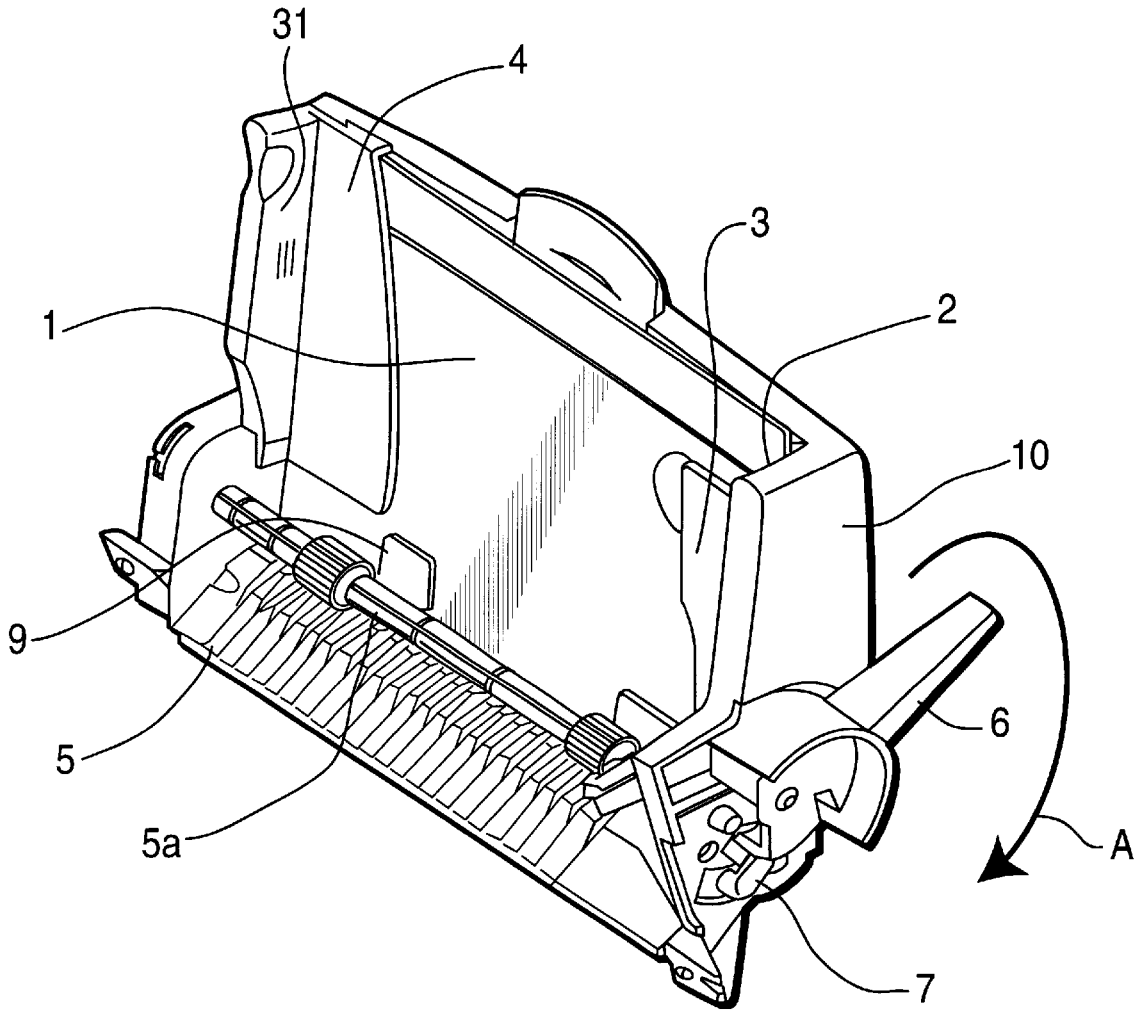
FIG. 1 is a perspective view of a sheet feeder.
Figure 2:
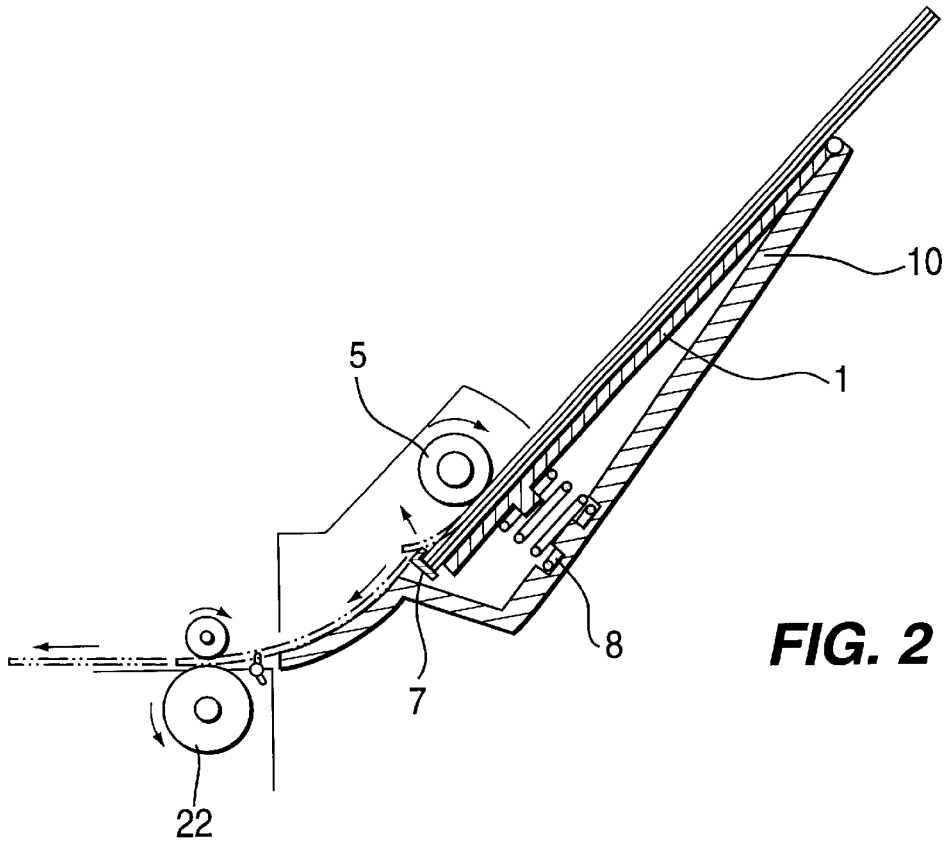
FIG. 2 is a side cross-sectional view of the sheet feeder of FIG. 1 adjusted for automatic sheet feeding.
Figure 3:
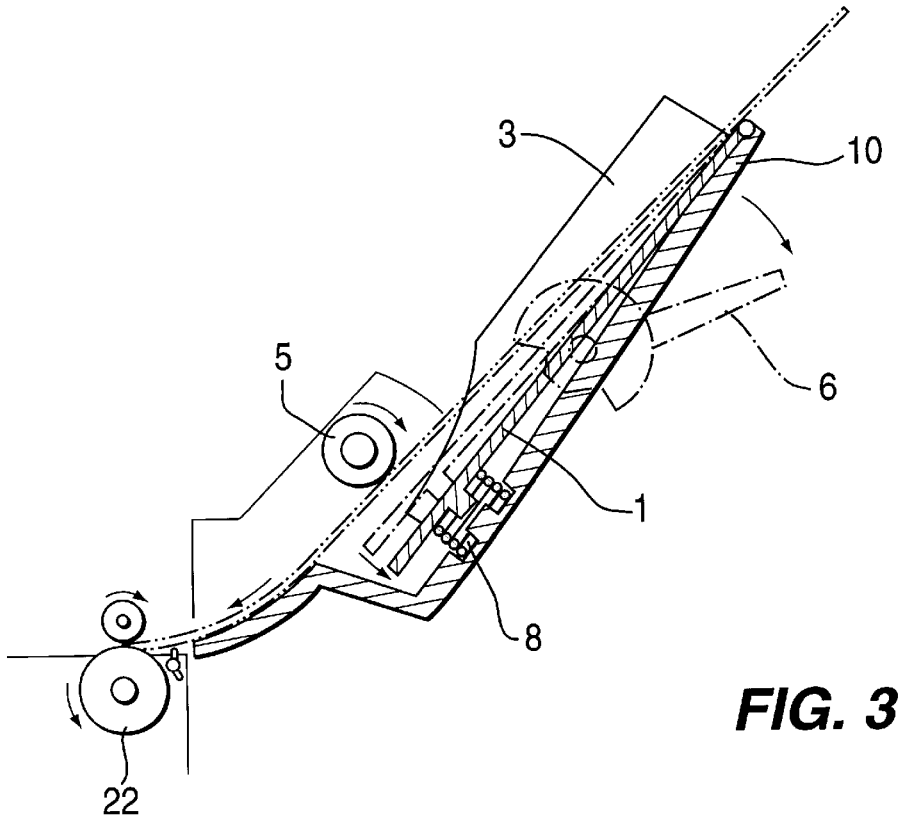
FIG. 3 is a side cross-sectional view of the sheet feeder of FIG. 1 adjusted for manual feeding.

Turning now to the drawings, FIG. 1 illustrates a sheet feeder that has printable mediums loaded into the device with a first edge abutting guide surface 2 of frame 10. Slidable guide rail 4 is positioned so surface 31 abuts a second edge of the printable medium that is opposite from the first edge. To load printable medium into the sheet feeder, tray 1 is separated from feed rollers 5*a* by rotating lever 6 in the direction denoted by arrow 'A'. The rotation of lever 6 compresses spring 8, as shown in FIG. 3. Automatic sheet feeding is performed by driving shaft 5*a* so that the feed rollers 5 are in rotatable contact with the stacked sheets. The movement of the paper is retarded by friction pads 9 and facilitated by sheet separator 7, as shown in FIG. 2.

Figure 4:
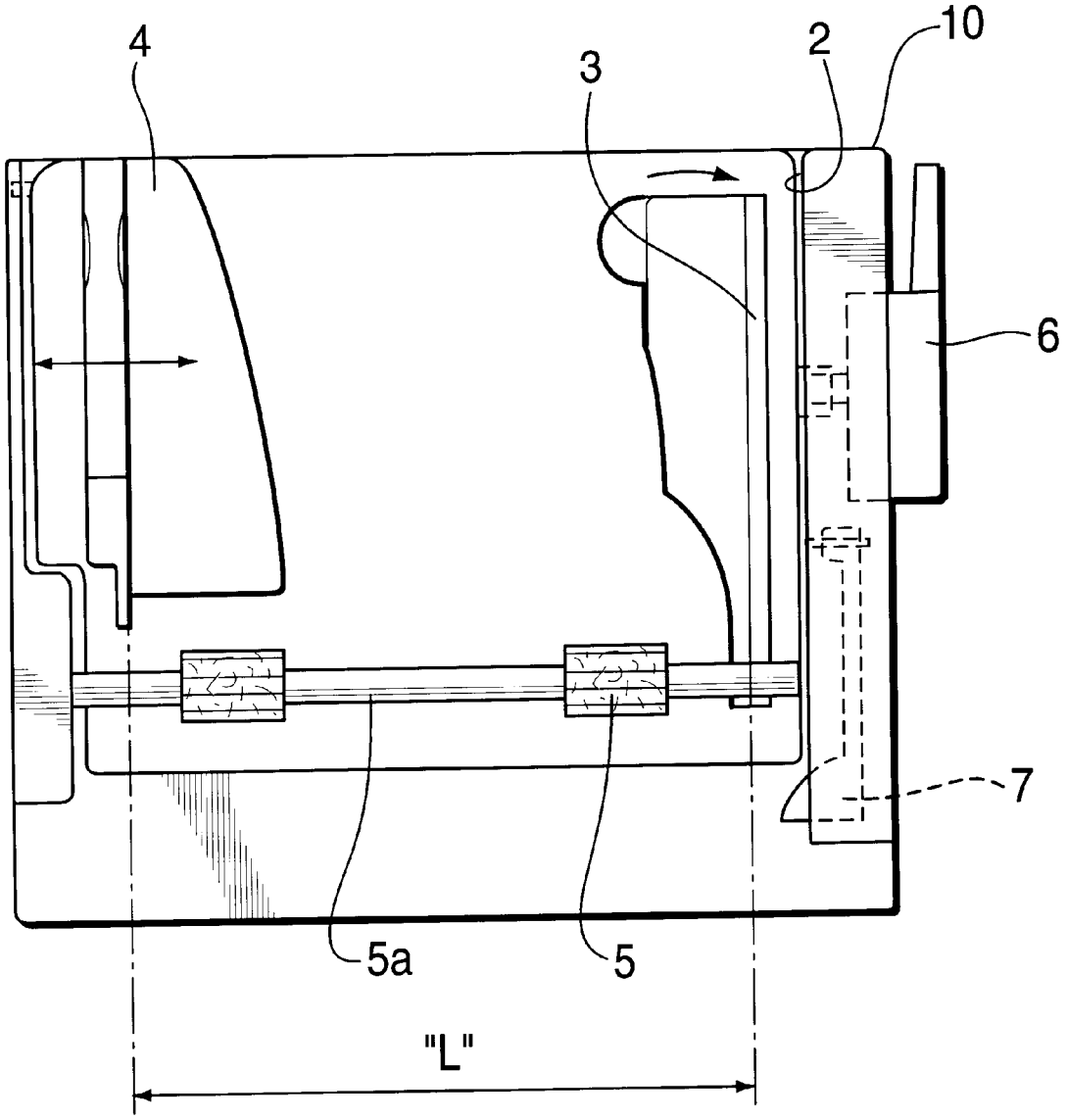
FIG. 4 is a plan view of the sheet feeder of FIG. 1 adjusted for manual feeding.

Some printable mediums must be fed through the sheet feeder using manual feeding because the increased thickness or the nons-standard dimensions of the printable medium prevents the sheet separator from being usable. As shown in FIG. 3, rotable guide rail 3 is rotated through an angle of 90° into a position perpendicular to the tray. FIG. 4 shows how rotable guide rail 3 causes the first edge of the printable medium to be offset with respect to the location of the first edge during an automatic sheet feeding operation. This causes the paper feeding process to take place along the length L. Then, tray 1 is forced down by rotating lever 6, to allow printable medium of greater thickness or non standard dimensions to be manually inserted into the sheet feeder to engage secondary feed roller 22.

Figure 5:
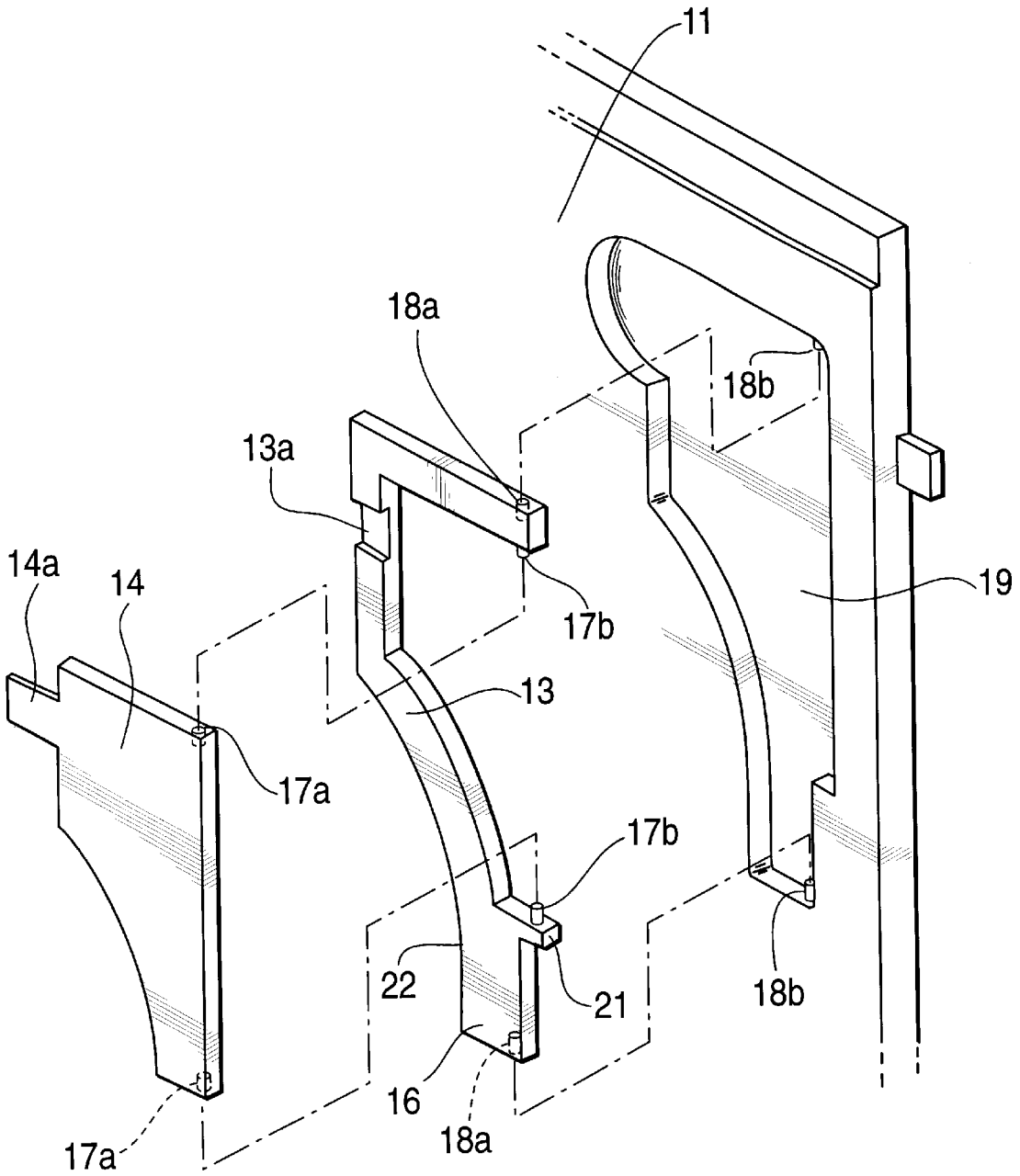
FIG. 5 is an exploded perspective view of first and second guides installed on the tray of a sheet feeder according to the principles of the present invention.

A sheet feeder constructed according to the principles of the current invention is shown in FIG. 5. Tray 11 has first and second guides 14 and 13 rotably attached on the side of tray 11 opposite that of the slidable guide (not shown). First guide 14 is rotated into a position perpendicular with tray 11 during an automatic sheet feeding operation and second guide 13 is rotated into a position perpendicular with tray 11 during the manual feeding operation.

Second guide 13 is rotably attached into recess 19, located in tray 11, by the interaction between pins 18*b,* located on the sides of the recess, and bores 18*a,* located on the sides of second guide 13. This construction allows second guide 13 to be rotated through an angle of 90° into a position perpendicular to tray 11. First guide 14 is rotably attached to second guide 13, by the interaction between bores 17*a,* located in the sides of first guide 14, and pins 17*b,* located in the sides of second guide 13. This construction allows first guide 14 to be rotated through an angle of 90° into a position perpendicular to tray 11.

Lower portion 16 of second guide 13 is designed to push tray 11 away from the feed rollers when the second guide is rotated into a position perpendicular to tray 11. Tray 11 is pushed away because surface 22 of second guide 13 contacts shaft 5*a* that supports feed rollers 5 and surface 21 of second guide 13 contacts tray 11. This combination of forces compresses the spring (not shown) and pushes tray 11 towards the base of frame 10. This increases the distance between the feed rollers and the tray to allow the sheet feeder to be operated using the manual sheet loading mode. Thus, second guide 13 feeds paper aligned along the same linear location on the tray as that used by first guide 14.

Furthermore, first guide 14 and second guide 13 are designed so that they may be operated simultaneously. First guide 14 has a protrusion that is matable with a groove in second guide 13. This causes first guide 14 to be rotated into a position perpendicular with the tray whenever the second guide is rotated into a position perpendicular with the tray.

Figure 6A:
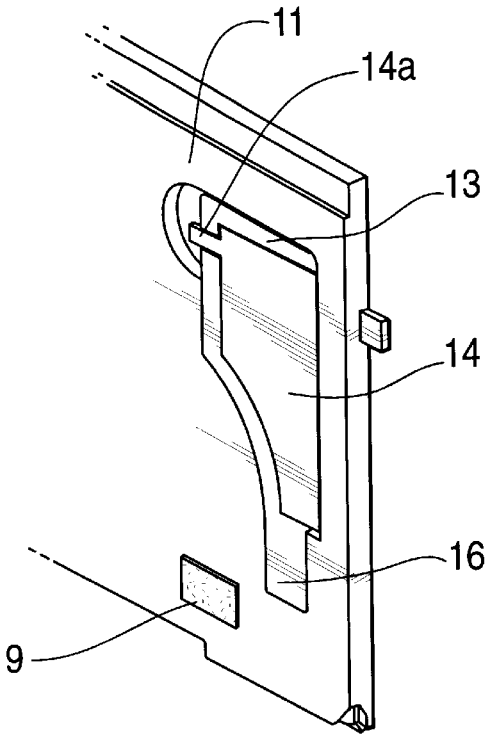
FIG. 6A is a perspective view of the sheet feeder of FIG. 5 showing both the guides recessed into the tray.
Figure 6B:
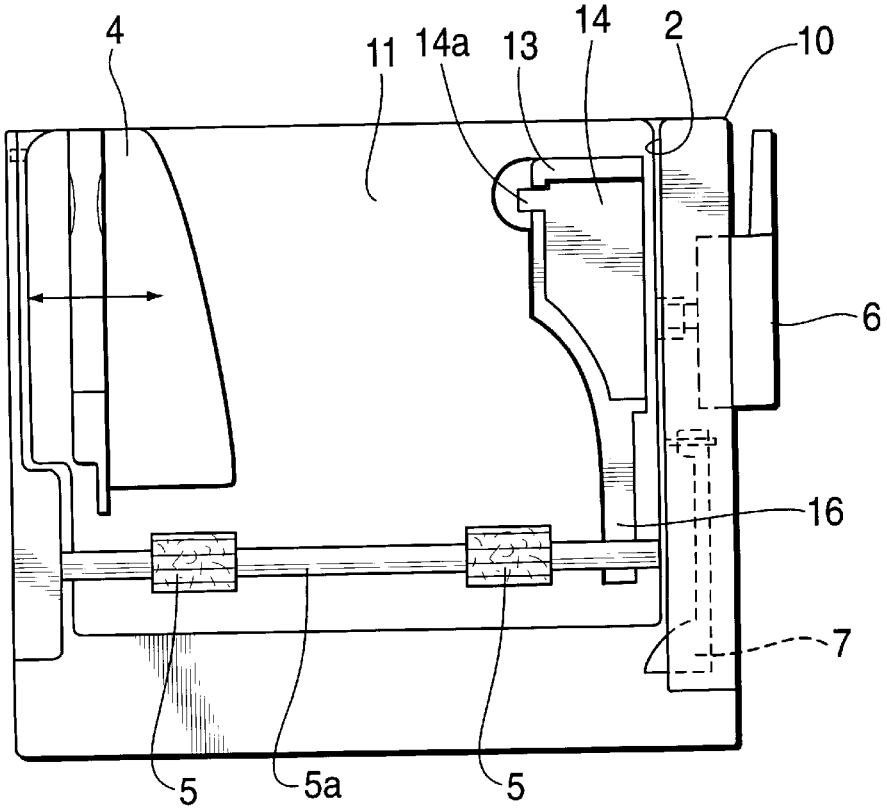
FIG. 6B is a plan view of the sheet feeder of FIG. 6A.

FIGS. 6A and 6B both the show the sheet feeder with both guides recessed into the tray. Tray 11 is biased against feed rollers S by spring 8 and the stacked paper is aligned against surface 2 of frame 10 for feeding into the image forming apparatus. Guide rail 4 is in contact with an edge of the stacked paper opposite that in contact with surface 2.

Figure 7A:
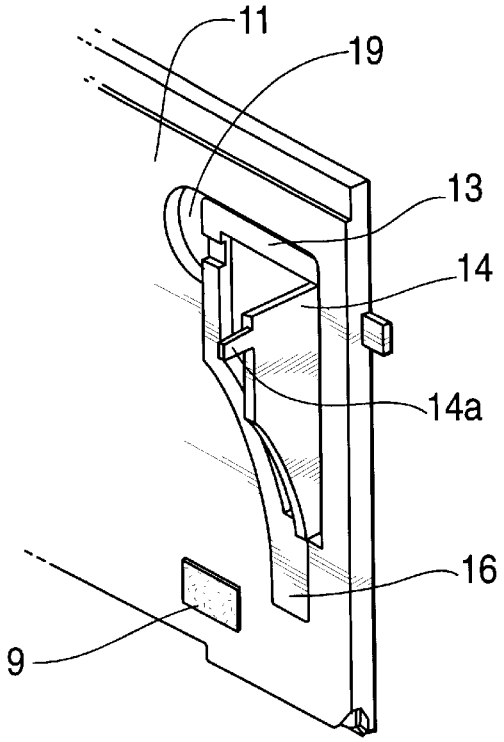
FIG. 7A is a perspective view of the sheet feeder of FIG. 5 showing only the first guide rail rotated into a position perpendicular to the tray.
Figure 7B:
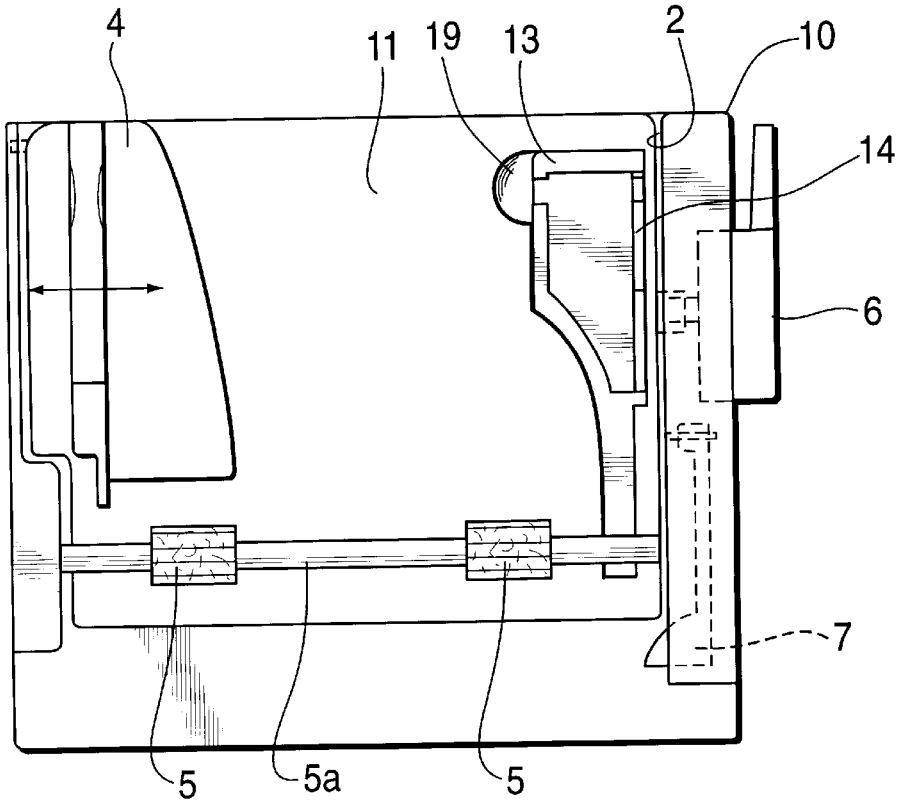
FIG. 7B is a plan view of the sheet feeder of FIG. 7A.

FIGS. 7A and 7B both show the sheet feeder with first guide 14 rotated through an angle of 90° to a position perpendicular to tray 11. Second guide 13 is recessed into recess 19. This position is used by the sheet feeder when in automatic sheet loading mode. This mode can be used for the automatic feeding of a printable medium that has a thickness greater than that of standard paper or a non standard size. For example, when using an envelope, one edge of the envelope is in contact with the inner surface of first guide 14 and the envelope's opposite edge is in contact with slidable guide rail 14. When the sheet feeder is operating in automatic mode, the upper surface of tray 11 or the top sheet in a stack of cut sheets remains in contact with feed roller 5. Feed roller 5 is in rotary contact with the leading edge of the top sheet of paper to create a frictional force that causes the sheet of paper to be loaded into the image forming device. Thus, non standard paper is automatically fed into the image forming apparatus by feed rollers 5 without using sheet separator 7.

Figure 8A:
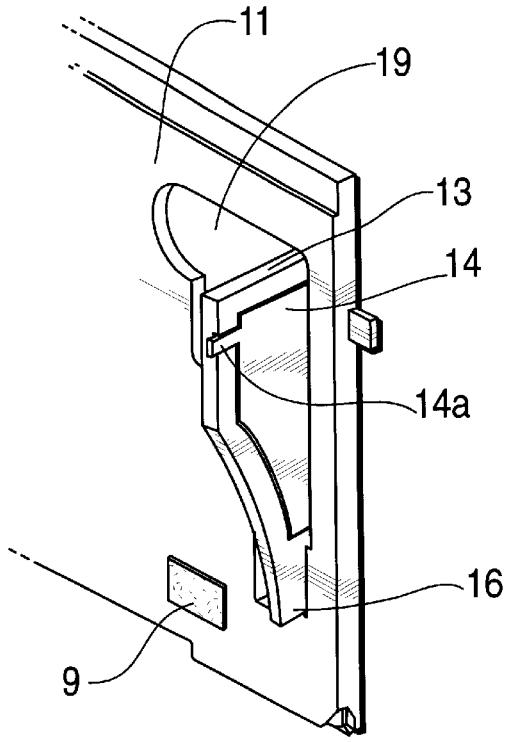
FIG. 8A is a perspective view of the sheet feeder of FIG. 5 showing both the first and second guides rotated into a position perpendicular to the tray.
Figure 8B:
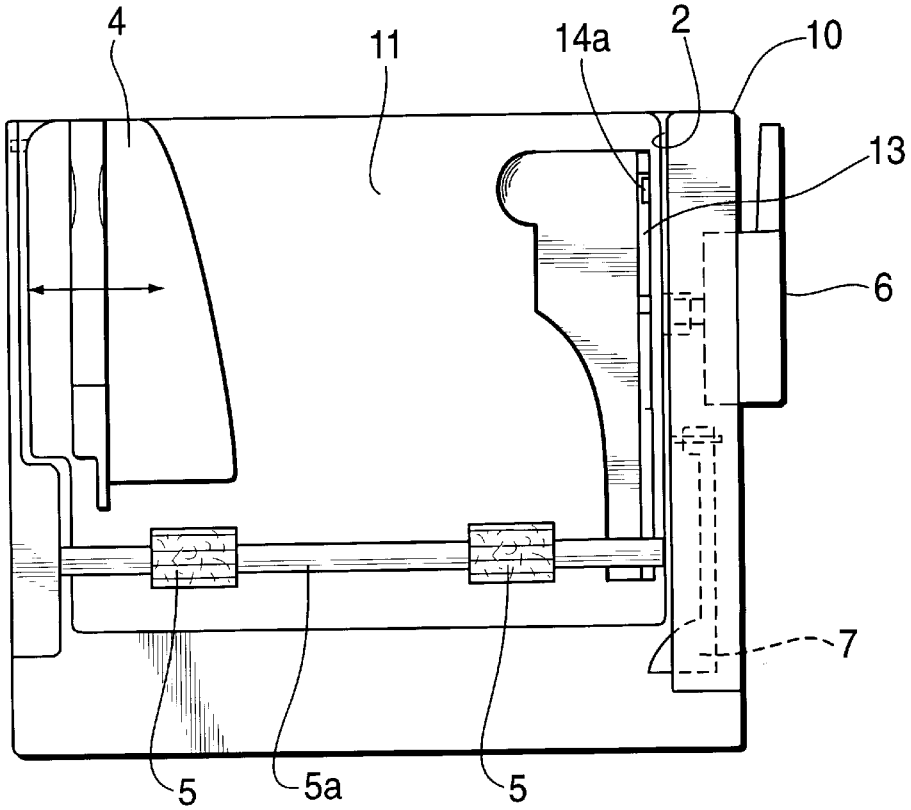
FIG. 8B is a plan view of the sheet feeder of FIG. 8A.

To manually feed non standard paper through the sheet feeder the first and second guides 14 and 13 are both rotated through a 90° angle into a position perpendicular to said tray, as shown in FIGS. 8A and 8B. Second guide 13 automatically rotates first guide 14 due to the contact between groove 13*a* in second guide 13 and protruding member 14*a* in first guide 14.

Figure 9:
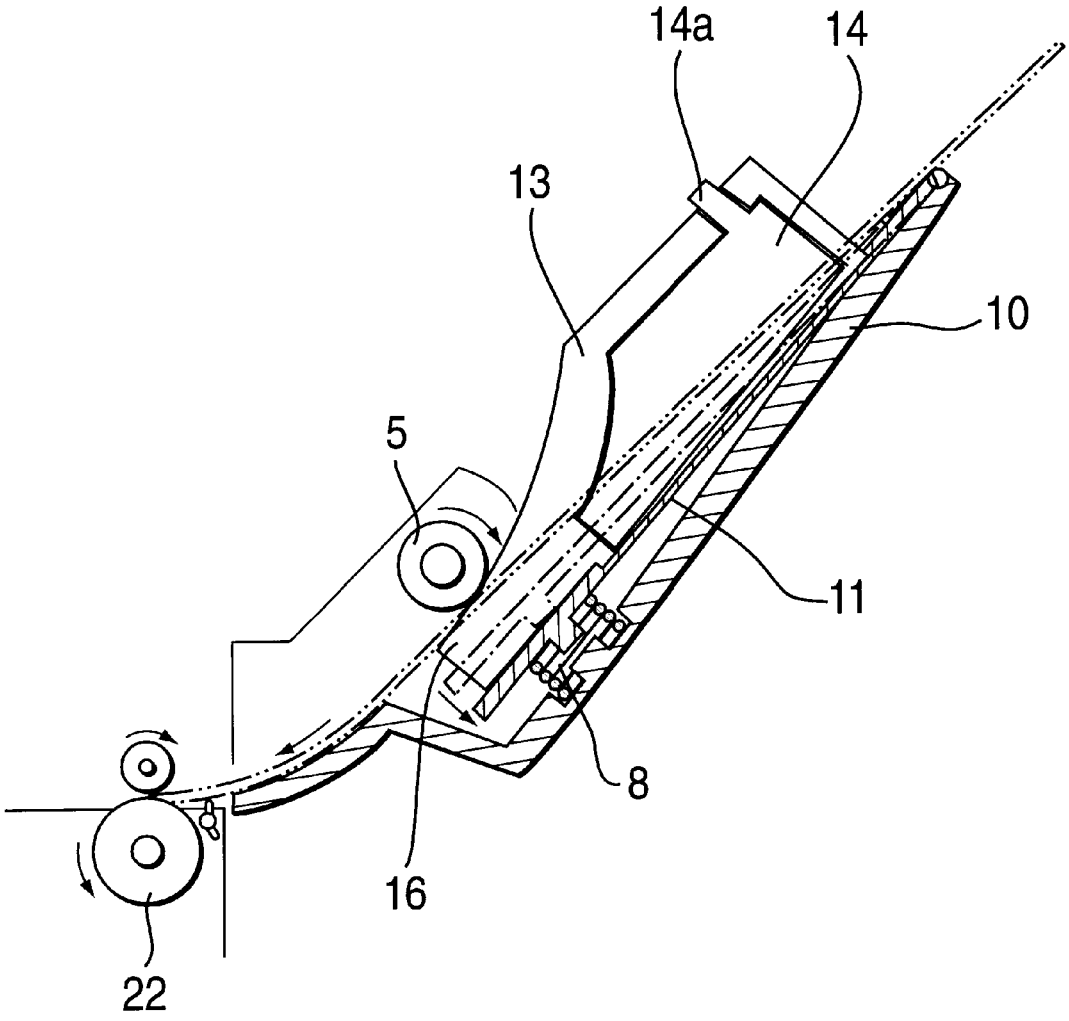
FIG. 9 is a cross-sectional view of the sheet feeder of FIG. 5 adjusted for the manual feeding of printable mediums having a greater thickness or different dimensions from that of standard paper.

As shown in FIG. 9, when second guide 13 is rotated through an angle of 90° into a position perpendicular with tray 11, projected portion 16 engages shaft 5*a* and causes feed rollers 5 to be moved farther away from tray 11. This forces tray 11, which is hinged to frame 10 on one end, towards the base of the frame and compresses spring 8. As a result, manually fed paper advances directly to and comes into contact with the secondary feed roller 22.

As detailed above, this improved sheet feeder enables a user to select of either automatic or manual modes for feeding nonstandard printable medium into an image formation apparatus, using a simplified operating guide structure that improves system reliability and enhances the functionality of the sheet feeder.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. An automatic sheet feeder for use with an image forming apparatus, comprising:

a pickup roller feeding a plurality of cut sheets of paper into said image forming apparatus and conveying a sheet to a second roller;

a tray contained in a frame and supporting said cut sheets of paper, said tray having a first recess near an edge, a first guide contained in said recess and rotably attached to said tray and a second guide rotably attached to said first guide, said first guide forming a second recess when said second guide is recessed in said first recess, said second recess being a smaller portion of said first recess defined by both an inwardly facing edge of said second guide and an inwardly facing edge of said first recess;

said first guide having a portion contactable with a shaft supporting said pickup roller when said first guide is rotated and bracing said tray at an increased distance from said pickup roller;

a spring positioned between said tray and said frame and applying a separating force to both said tray and said frame;

said second guide pivotable to a position perpendicular to said tray when said sheet feeder is operating in an automatic sheet loading mode; and said first guide rotatable to a position perpendicular to said tray when said sheet feeder is in a manual sheet loading mode.

2. The automatic sheet feeder of claim 1, further comprising a lever rotatably attached to said frame and capable of pushing said tray towards said tray and causing said tray and said pickup roller to move farther apart.

3. The automatic sheet feeder of claim 1, further comprised of said second guide having a protruding section matable with a corresponding groove in said first guide causing said second guide to rotate away from said tray when said first guide rotates away from said tray.

4. The automatic sheet feeder of claim 1, further comprising a slidable guide movable in a direction perpendicular to said first guide and said second guide.

5. The automatic sheet feeder of claim 1, with said tray having at least one friction pad on a side contactable with said cut sheets of paper.

6. The automatic sheet feeder of claim 1, with said first guide further comprising:

a first plurality of hollows that are cylindrically shaped and located in a side edge of said first guide;

a first plurality of pins attached on a side edge of said first guide facing said second guide; and a second plurality of pins attached to a side edge of said recess and engaged with said hollows.

7. The automatic sheet feeder of claim 1, with said second guide further comprising a second plurality of hollows having a cylindrical shape, positioned on a side edge of said second guide, and engaged with said first plurality of pins protruding from said first guide.

8. The automatic sheet feeder of claim 1, further comprising a sheet separator hingedly attached to said frame and cooperating with said feed roller to separate a top sheet from said cut sheets of paper stacked on said tray.

9. An automatic sheet feeder for use with an image forming apparatus, comprising:

a pickup roller feeding a plurality of cut sheets of paper into said image forming apparatus and conveying a sheet to a second roller;

a tray contained in a frame and supporting said cut sheets of paper, said tray having a first recess near an edge, a first guide contained in said recess and rotably attached to said tray and a second guide rotably attached to said first guide, said first guide forming a second recess when said second guide is recessed in said first recess, said second recess being a smaller portion of said first recess defined by both an inwardly facing edge of said second guide and an inwardly facing edge of said first recess;

said first guide having a portion contactable with a shaft supporting said pickup roller when said first guide is rotated and bracing said tray at an increased distance from said pickup roller, said second guide having a protruding section matable with a corresponding groove in said first guide causing said second guide to rotate away from said tray when said first guide rotates away from said tray;

a spring positioned between said tray and said frame and applying a separating force to both said tray and said frame;

said second guide pivotable to a position perpendicular to said tray when said sheet feeder is operating in an automatic sheet loading mode; and said first guide rotatable to a position perpendicular to said tray when said sheet feeder is in a manual sheet loading mode.

10. The automatic sheet feeder of claim 9, further comprising a lever rotatably attached to said frame and capable of pushing said tray towards said tray and causing said tray and said pickup roller to move farther apart.

11. The automatic sheet feeder of claim 9, further comprising a slidable guide movable in a direction perpendicular to said first guide and said second guide.

12. The automatic sheet feeder of claim 9, with said tray having at least one friction pad on a side contactable with said cut sheets of paper.

13. The automatic sheet feeder of claim 9, with said first guide further comprising:

a first plurality of hollows that are cylindrically shaped and located in a side edge of said first guide;

a first plurality of pins attached on a side edge of said first guide facing said second guide; and a second plurality of pins attached to a side edge of said recess and engaged with said hollows.

14. The automatic sheet feeder of claim 9, with said second guide further comprising a second plurality of hollows having a cylindrical shape, positioned on a side edge of said second guide, and engaged with said first plurality of pins protruding from said first guide.

15. The automatic sheet feeder of claim 9, further comprising a sheet separator hingedly attached to said frame and cooperating with said feed roller to separate a top sheet from said cut sheets of paper stacked on said tray.

16. An automatic sheet feeder for use with an image forming apparatus, comprising:

a pickup roller feeding a plurality of cut sheets of paper into said image forming apparatus and conveying a sheet to a second roller;

a tray contained in a frame and supporting said cut sheets of paper, said tray having a first recess near an edge, a first guide contained in said recess and rotably attached to said tray and a second guide rotably attached to said first guide, said first guide forming a second recess when said second guide is recessed in said first recess, said second recess being a smaller portion of said first recess defined by both an inwardly facing edge of said second guide and an inwardly facing edge of said first recess;

said first guide having a portion contactable with a shaft supporting said pickup roller when said first guide is rotated and bracing said tray at an increased distance from said pickup roller, said second guide having a protruding section matable with a corresponding groove in said first guide causing said second guide to rotate away from said tray when said first guide rotates away from said tray;

a lever rotatably attached to said frame and capable of pushing said tray towards said tray and causing said tray and said pickup roller to move farther apart;

a slidable guide movable in a direction perpendicular to said first guide and said second guide;

a spring positioned between said tray and said frame and applying a separating force to both said tray and said frame;

said second guide pivotable to a position perpendicular to said tray when said sheet feeder is operating in an automatic sheet loading mode; and said first guide rotatable to a position perpendicular to said tray when said sheet feeder is in a manual sheet loading mode.

17. The automatic sheet feeder of claim 16, with said tray having at least one friction pad on a side contactable with said cut sheets of paper.

18. The automatic sheet feeder of claim 16, with said first guide further comprising:

a first plurality of hollows that are cylindrically shaped and located in a side edge of said first guide;

a first plurality of pins attached on a side edge of said first guide facing said second guide; and a second plurality of pins attached to a side edge of said recess and engaged with said hollows.

19. The automatic sheet feeder of claim 16, with said second guide further comprising a second plurality of hollows having a cylindrical shape, positioned on a side edge of said second guide, and engaged with said first plurality of pins protruding from said first guide.

20. The automatic sheet feeder of claim 16, further comprising a sheet separator hingedly attached to said frame and cooperating with said feed roller to separate a top sheet from said cut sheets of paper stacked on said tray.

* * * * *